US006257120B1

(12) United States Patent
Miyazawa et al.

(10) Patent No.: US 6,257,120 B1
(45) Date of Patent: Jul. 10, 2001

(54) SWASH PLATE TYPE COMPRESSOR IN WHICH A PISTON JOINT USES A ROTATIONAL ELLIPTICAL SURFACE AND A SPHERICAL SURFACE OPPOSITE THERETO

(75) Inventors: Kiyoshi Miyazawa, Annaka; Kiyoshi Terauchi, Isesaki; Yoshitaka Ootsuki, Sawa-gun, all of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/344,504

(22) Filed: Jun. 25, 1999

(30) Foreign Application Priority Data

Jun. 30, 1998 (JP) ..... 10-183537

(51) Int. Cl.[7] ..... F04B 25/00
(52) U.S. Cl. ..... 92/71; 92/129
(58) Field of Search ..... 92/71, 129, 12.2; 417/269

(56) References Cited

U.S. PATENT DOCUMENTS

| | | | | |
|---|---|---|---|---|
| 4,168,632 | | 9/1979 | Fokker . | |
| 4,268,225 | | 5/1981 | Nakayama et al. . | |
| 4,480,964 | | 11/1984 | Skinner . | |
| 4,568,252 | | 2/1986 | Hattori et al. . | |
| 4,617,856 | * | 10/1986 | Miller et al. | 92/71 |
| 4,662,267 | | 5/1987 | Kaku et al. | 92/71 |
| 4,683,803 | * | 8/1987 | Miller et al. | 92/71 |
| 4,685,866 | | 8/1987 | Takenaka et al. . | |
| 4,734,014 | | 3/1988 | Ikeda et al. | 417/269 |
| 4,746,275 | | 5/1988 | Iwamori et al. . | |
| 4,752,191 | | 6/1988 | Onomura et al. | 417/269 |
| 4,762,468 | | 8/1988 | Ikeda et al. . | |
| 4,763,563 | | 8/1988 | Ikeda et al. . | |
| 4,781,539 | | 11/1988 | Ikeda et al. . | |
| 4,801,248 | | 1/1989 | Tojo et al. . | |
| 4,815,358 | | 3/1989 | Smith . | |
| 4,842,488 | | 6/1989 | Terauchi . | |
| 4,874,295 | | 10/1989 | Kobayashi et al. . | |
| 5,255,569 | | 10/1993 | Terauchi et al. . | |
| 5,397,218 | | 3/1995 | Fujii et al. . | |
| 5,415,077 | | 5/1995 | Ono . | |
| 5,483,867 | | 1/1996 | Ikeda et al. | 92/71 |
| 5,495,789 | | 3/1996 | Ogura et al. . | |
| 5,562,425 | | 10/1996 | Kimura et al. . | |
| 5,624,240 | | 4/1997 | Kawaguchi et al. . | |
| 5,950,480 | | 9/1999 | Fukushima | 72/336 |
| 5,950,521 | | 9/1999 | Fukishima et al. . | |
| 6,024,010 | * | 2/2000 | Kato et al. | 92/71 |

FOREIGN PATENT DOCUMENTS

| | | |
|---|---|---|
| 919719A2 | 6/1999 | (EP) . |
| 4965509 | 6/1974 | (JP) . |
| 56-138474 | 10/1981 | (JP) . |
| 61-135990 | 6/1986 | (JP) . |

* cited by examiner

*Primary Examiner*—John E. Ryznic
(74) *Attorney, Agent, or Firm*—Baker Botts L.L.P.

(57) ABSTRACT

In a swash plate type compressor in which a shoe (3) is interposed between a swash plate (5) and a reciprocally movable piston (2), a concave curved surface (21*a*) is made at an end of the piston to have an elliptical portion with an elliptical shape in cross section. The shoe has a convex spherical surface inserted into the concave curved surface and reciprocally moves the piston in accordance with a rotation of the swash plate.

8 Claims, 4 Drawing Sheets

SWASH PLATE TYPE COMPRESSOR IN WHICH A PISTON JOINT USES A ROTATIONAL ELLIPTICAL SURFACE AND A SPHERICAL SURFACE OPPOSITE THERETO

BACKGROUND OF THE INVENTION

The present invention relates in general to a compressor and more particularly to a swash plate type compressor.

A swash plate type compressor has a swash plate rotatably connected with a rotational shaft, a reciprocally movable piston, and a piston joint connecting the swash plate with the piston. The piston joint, for example, has a shoe which has a plain surface slidable along the swash plate and a convex curved surface on the opposite side of the plain surface, and a socket which has a concave spherical surface for receiving the projecting, convex curved surface of the piston, as shown for example in Japanese Unexamined Publications Nos. 61-135990, 49-65509, and 56-138474.

In the operational mode of the compressor, the shoe moves within the socket of the piston to have a wobbling motion in accordance with a rotational movement of the swash plate. Thus, it is strongly desired to maintain a favorable lubricating efficiency between the convex curved surface of the shoe and the concave spherical surface of the socket.

For example, U.S. Pat. No. 4,734,014 shows a structure in which a convex portion of the shoe is formed to have smaller radius curvature than a curvature of a concave portion of the socket and a top of the concave spherical curved surface is provided with a plain surface. In this structure, an oil reservoir is formed between the plain surface of the shoe and the recess or concave portion of the socket to provide a desirable lubricity or a lubricant characteristic. Here, a position where the shoe contacts with the concave portion of the socket is located adjacent to the oil reservoir. Namely, an angular portion located at a border between the spherical curved surface of the shoe and the plain surface is contacted with the concave portion of the socket.

In general, there are some clearances or gaps between the concave portion of the socket and the convex or projecting portion of the shoe and between the plain surface of the shoe and the swash plate and, therefore, a relative vibration is produced in the axial direction of the compressor in an operation of the compressor and, a relative vibration is produced in the direction perpendicular to the axial direction. As a result of the relative vibrations and the wobbling motion as described above, it is foreseen that a special condition is generated that the border portion of the shoe contacts the concave portion of the socket, at a limited position of a portion or a point of the circumferential portion of the oil reservoir.

When such a special condition as described above occurs, a reaction of the compression by the reciprocal movement of the piston is concentrated on a part or point of its contacted area. Accordingly, in the conventional shoe structure in which an angular portion is contacted with the concave spherical surface of the socket, it is likely that the concave portion of the socket is deformed due to plastic deformation, plastic flow and/or frictional wear. Consequently, there is a problem that the relative vibrations are likely to be generated.

SUMMARY OF THE INVENTION

It is therefore an object of the present invention to provide an improved swash plate type compressor which has a piston joint of higher lubricity or lubricating efficiency with less tendency of deformation in the concave portion of the socket.

Other objects of the present invention will become clear as the description proceeds.

According to the present invention, there is provided a swash plate type compressor which includes a driving shaft, a swash plate rotatably coupled to the driving shaft, a reciprocally movable piston having at its end a concave curved surface opposite to the swash plate, and a shoe interposed between the swash plate and the concave curved surface for reciprocally moving the piston in accordance with a rotation of the swash plate. The shoe has a convex spherical surface inserted into the concave curved surface. In the swash plate type compressor, the concave curved surface has an elliptical portion with an elliptical shape in cross section.

DESCRIPTION OF THE EMBODIMENT

Figure 1:
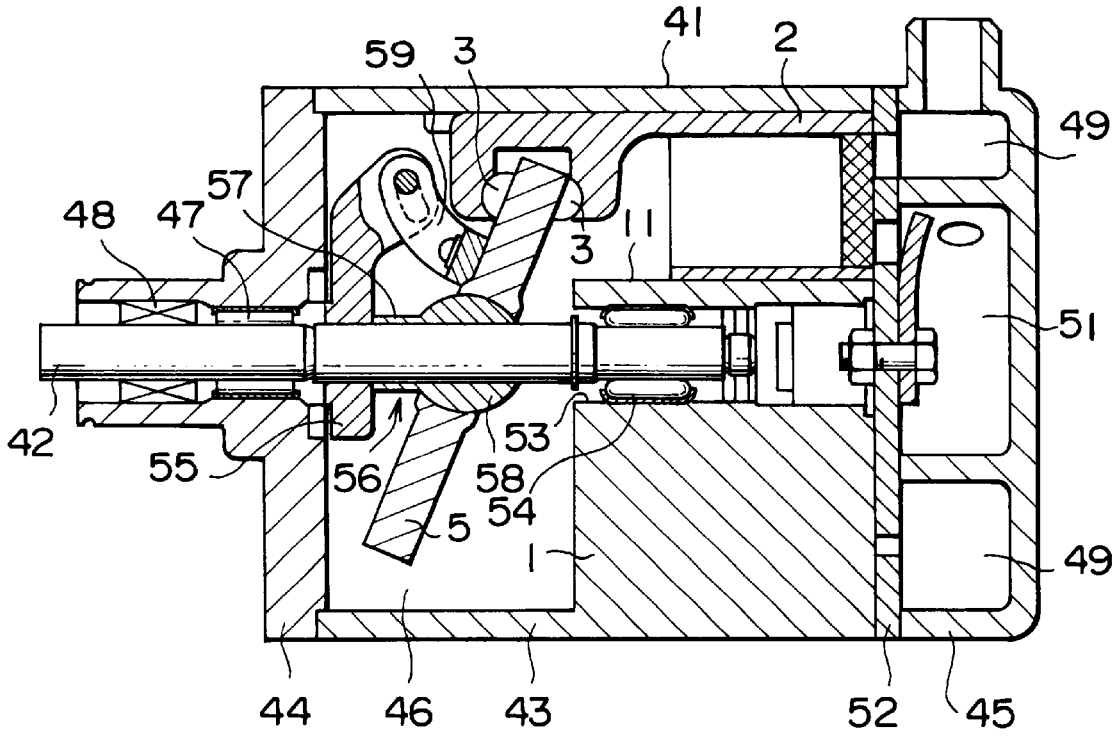
FIG. 1 is a longitudinal section view of a swash plate type compressor according to a first embodiment of the invention.

With reference to FIG. 1, description will be made as regards a swash plate type compressor according to a first embodiment of the invention.

The compressor comprises a casing 41, a cylinder block 1 having a plurality of cylinder bores 11, a driving shaft 42, a swash plate 5, a plurality of single-head pistons 2, and a pair of shoes 3, which are assembled in the manner known in the art.

The casing 41 comprises a casing body 43, a front end plate 44, and a cylinder head 45. The casing body 43 is of a cylindrical shape and is integrally formed with the cylinder block 1. The front end plate 44 has a generally funnel-like shape and is attached to one open end of the casing body 43 to close the one open end. Thus, a crank chamber 46 is defined between the cylinder block 1 and the front end plate 44. The front end plate 44 has a shaft seal cavity in which a radial needle bearing 47 and a shaft seal member 48 are disposed. The cylinder head 45 has a suction chamber 49 and a discharge chamber 51 and is attached to the other end of the casing body 43 through a valve plate 52.

The cylinder block 1 has a center hole 53 and the cylinder bores 11 equiangularly spaced about an axis of the driving shaft 42. The center hole 53 is formed in a portion of the cylinder block 1 at a center of the plurality of cylinder bores 11. Within the center hole 53, a radial needle bearing 54 is disposed. The cylinder bores 11 are formed in an outer peripheral zone of the cylinder block 1 at an equal interval in a circumferential direction to surround the center hole 53.

The driving shaft 42 has one end portion rotatably supported by the front end plate 44 through the radial needle bearing 47 and the other end portion rotatably supported by the cylinder block 1 through the radial needle bearing 54. A top of the one end portion of the driving shaft 42 protrudes through the front end plate 44 outward of the casing 41. The shaft seal member 48 seals a gap between the driving shaft 42 and the front end plate 44. On the driving shaft 42, a rotor 55 and a swash-plate fitting member 56 are mounted. The rotor 55 is fixed to the driving shaft 42 to be rotatable with the driving shaft 42. The swash-plate fitting member 56 comprises a cylindrical member 57 and a spherical or ball portion 58 and is movable on the driving shaft 42 in an axial direction of the driving shaft 42.

The swash plate 5 has a disk shape and is rotatably attached on the ball portion 58 of the swash-plate fitting member 56. Furthermore, the swash plate 5 is coupled to the rotor 55 through an arm 59 swingably coupled to a top end portion of the rotor 55. With this structure, the swash plate 5 is rotated together with the driving shaft 42 and can be varied in its inclination angle with respect to the axial direction. Thus, the compressing capacity of this compressor is variable dependent on the inclination angle.

Figure 2:
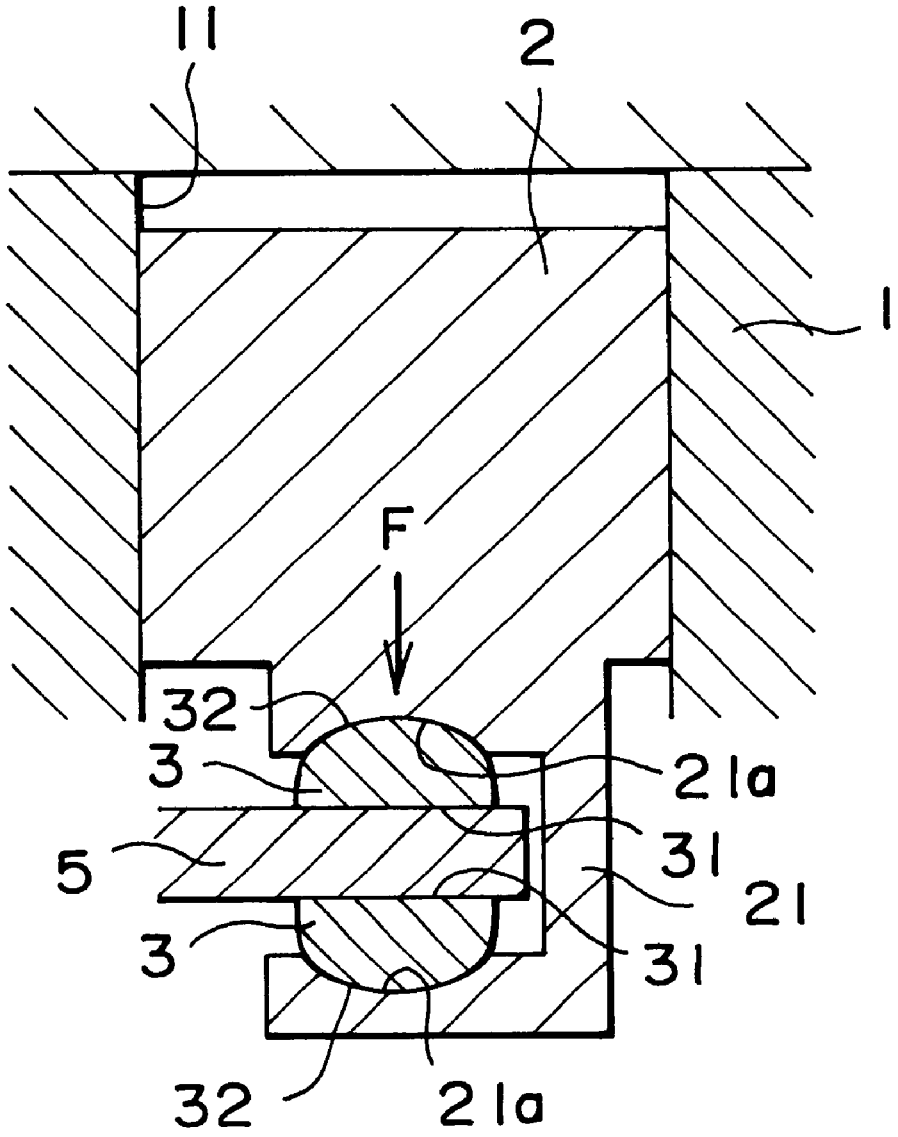
FIG. 2 is an explanatory view of a main portion of the swash plate type compressor illustrated in FIG. 1.

Referring to FIG. 2 in addition, the piston 2 is axially and reciprocally movable in a cylinder bore 11 formed in a cylinder block 1. The piston 2 has at its axial end a socket 21 which is formed integral with the piston 2. The socket 21 has concave curved surfaces 21*a* in a spaced confronting relation. A pair of shoes 3 is provided in an opposed relation with these concave curved surfaces 21*a*. A swash plate 5 is rotatable coupled to the driving shaft (not shown) and is inserted into a space between the paired shoes 3.

When the driving shaft is rotated, the swash plate 5 forces to rotate the piston 2 in the cylinder bore 11 through the shoes 3 and the socket 21. Consequently, a series of motion of suction, compression, and discharge, respectively, of a fluid is repeatedly carried out. Hereinafter, a compressive reaction to the piston 2 at the time of compression of the fluid is referred to as alphabetical character F. Herein, a combination of the shoes 3 and the socket is referred to as a piston joint.

Each of the shoes 3 has a plain surface 31 slidable to an axial end surface of the swash plate 5, a projecting or convex shaped spherical surface 32 on the opposed side of the plain surface 31, and a cylindrical surface between the plain surface 31 and the convex spherical surface 32. The convex spherical surface 32 is inserted into the concave curved surface 21*a* of the socket 21.

Figure 3:
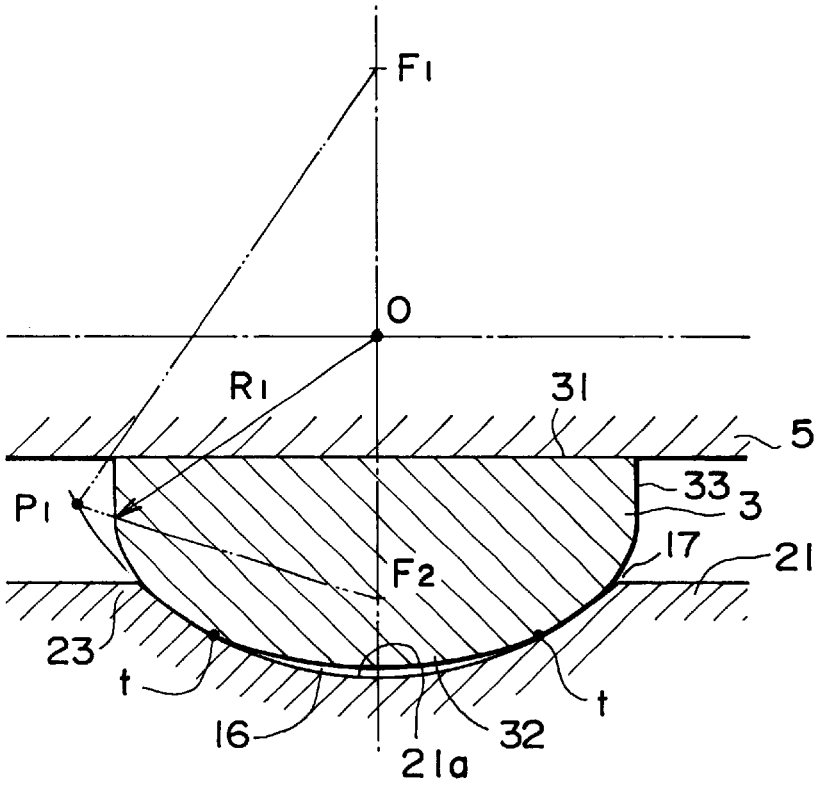
FIG. 3 is an enlarged diagram of a piston joint included in the swash plate type compressor of FIG. 1.

With reference to FIG. 3 together with FIG. 2, the description will be made as regards a correlation between the concave curved surface 21*a* and the convex spherical surface 32.

First, the concave curved surface 21*a* has a elliptical body portion having an elliptical shape in cross section. More specifically, on a line perpendicular to the swash plate 5, an ellipse having two focuses F1 and F2 is formed, and in other words, a cross sectional or a profile of the concave curved surface 21*a* is formed along a locus of point P1. Namely, the concave curved surface 21*a* is formed along a rotational elliptical surface which is obtained by rotating an ellipse around a major axis thereof. In other words, the concave curved surface 21*a* is formed along a spheroid or along an ellipsoids of revolution.

On the other hand, the convex spherical surface 32 has a cross section which is formed along a complete round having a radius R1 at a center of a point O which is an intermediate point between the two focuses F1 and F2.

When the convex spherical surface 32 is inserted into the concave curved surface 21*a*, a ring shaped contact portion "t" is formed around the major axis of the ellipse. The ring shaped contact portion "t" is forcibly pressed against the concave curved surface 21*a* of the socket 21 by a reaction force of the compression.

Further, an inside portion of the ring shaped contact portion t is spaced from the concave curved surface 21*a*. Namely, there is a spaced portion which is left from the concave curved surface 21*a* on the convex spherical surface 32, at the portion inside the ring shaped contact portion t, and an oil reservoir is formed between the spaced portion and the concave curved surface 21*a*. A portion located outside the ring shaped contact portion "t" is located in an opposed relation with a wedge-shaped clearance left therebetween so that an oil introduction gap 17 is formed between the concave curved surface 21*a* and the convex spherical surface 32 to extend around an entire circumference. Preferably, the clearance has a width of 0–150 $\mu$m at the end of the concave curved surface 21*a*.

Figure 4:
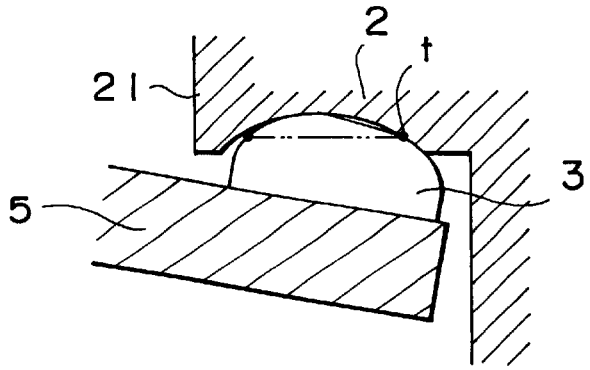
FIG. 4 is an explanatory view of the piston joint illustrated in FIG. 3.

With reference to FIG. 4 in addition, the description will be proceeded.

As well known in the art, the swash plate 5 has an inclination angle varying in accordance with a rotation of the driving shaft. In accordance with the variation of the inclination angle, the shoes 3 move to have a wobbling motion along the concave curved surface 21*a* of the socket 21. In this event, a lubricant contained in the fluid to be compressed is introduced into the oil reservoir 16 from the oil introduction gap 17 and stored in the oil reservoir 16. Accordingly, a favorable lubrication effect can be obtained between the concave curved surface 21*a* and the convex spherical surface 32, particularly at the ring shaped contact portion "t". In addition, since the oil introduction gap 17 is a gap of a wedge shape as described above, an efficient supply of the lubricant to the oil reservoir 16 can be established.

A position of the contact portion "t" is determined so that it is not removed or taken away from the contacted position even when the swash plate is positioned at a maximum angle of inclination. If necessary, a plain surface of a recess can be provided on the inside of the ring shaped contact portion "t" of the shoe 3.

As described above, the ring shaped contact portion "t" and its adjacent portion have a shape which is formed along with the rotational elliptical surface. Therefore, there is less fear or danger that an angular portion of each of the shoes 3 abuts against the concave curved surface 21*a* of the socket 21 which results in plastic deformation or any other deformation due to plastic flow and/or frictional wear.

Figure 5:
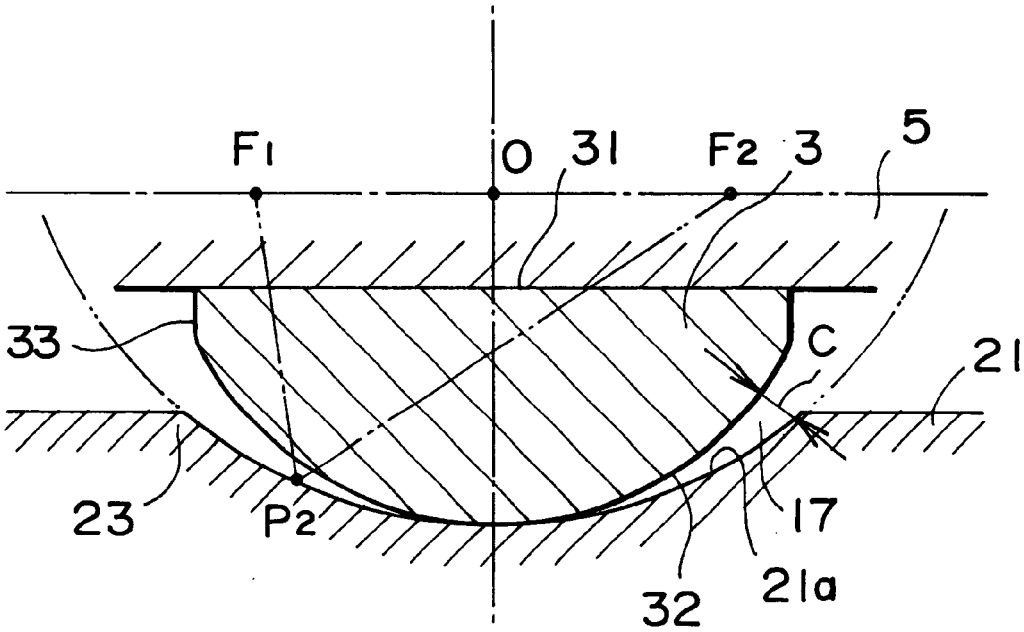
FIG. 5 is an enlarged diagram of a piston joint included in a swash plate type compressor according to a second embodiment of the present invention.

With reference to FIG. 5, the description will be directed to a swash plate type compressor according to a second embodiment of the present invention. Similar parts are designated by like reference numerals.

In FIG. 5, on a line parallel to the swash plate 5, there is provided an ellipse having two focuses F1 and F2, and in other words, a sectional shape of the concave curved surface 21*a* is formed along a locus of a point P2. Namely, the concave curved surface 21*a* is formed along with a rotational elliptical surface which is obtained by rotating an ellipse around a minor or shorter axis thereof.

On the other hand, a cross section of the convex spherical surface is formed along a complete round having a center at a point O which is an intermediate point between the two focuses F1 and F2 of the ellipse. A clearance C is preferably about 0–150 $\mu$m at an end of the concave curved surface 21*a*.

In the piston joint, there is less fear or danger that an angular portion of each of the shoes 3 abuts against the concave curved surface 21*a* of the socket 21 which results in plastic deformation or any other deformation due to plastic flow and/or frictional wear.

While the present invention has thus far been described in connection with a few embodiments thereof, it will readily be possible for those skilled in the art to put this invention into practice in various other manners. For example, the piston joint described above is applicable to not only a fixed volume type compressor in which an angle of the swash plate is fixed relative to the driving axis but also a variable volume type compressor with the angle of the swash plate being variable.

What is claimed is:

1. A swash plate type compressor including a driving shaft, a swash plate rotatably coupled to said driving shaft, a piston reciprocally movable in a predetermined direction and having at its end a concave curved surface opposite to said swash plate, and a shoe interposed between said swash plate and said concave curved surface for reciprocally moving said piston in accordance with a rotation of the swash plate, said shoe having a convex spherical surface inserted into said concave curved surface, wherein said concave curved surface has a curvature defined by rotating an ellipse about a first axis, wherein said first axis extends in said predetermined direction.

2. A swash plate type compressor as claimed in claim 1, wherein said convex spherical and said concave curved surfaces are in contact with each other at a position which is determined not to be released from each other even when said swash plate is located in a maximum angle of inclination.

3. A swash plate type compressor as claimed in claim 1, wherein said first axis passes through two foci of said ellipse.

4. A swash plate type compressor as claimed in claim 3, wherein said convex spherical said concave curved surfaces have a clearance left therebetween, said clearance being about 0–150 $\mu$m at the end of said concave curved surface.

5. A swash plate type compressor as claimed in claim 1, wherein a second axis passes through two foci of said ellipse, and said second axis is perpendicular to said first axis.

6. A swash plate type compressor as claimed in claim 5, wherein said convex spherical and said concave curved surfaces have a clearance left therebetween, said clearance being about 0–150 $\mu$m at the end of said concave curved surface.

7. A swash plate type compressor as claimed in claim 1, wherein said elliptical portion is formed along an ellipsoid of revolution.

8. A swash plate type compressor as claimed in claim 1, wherein said elliptical portion is formed along a spheroid.

* * * * *